United States Patent [19]

Bernhardt

[11] 4,423,646

[45] Jan. 3, 1984

[54] PROCESS FOR PRODUCING A ROTARY DRILLING BIT

[75] Inventor: David L. Bernhardt, Canton, Mich.

[73] Assignee: N.C. Securities Holding, Inc., Livonia, Mich.

[21] Appl. No.: 249,039

[22] Filed: Mar. 30, 1981

[51] Int. Cl.[3] ..... B21K 5/02; B22C 9/04; B22D 19/00

[52] U.S. Cl. ..... 76/108 R; 164/34; 164/97; 29/527.3

[58] Field of Search ..... 76/107 R, 108 R, 108 A, 76/DIG. 3; 164/97, 9–11, 34, 246; 29/527.2, 527.3

[56] References Cited

U.S. PATENT DOCUMENTS

| | | | |
|---|---|---|---|
| 1,090,533 | 3/1914 | Heinkel | 76/DIG. 3 |
| 1,844,351 | 2/1932 | Falkenstein | 76/DIG. 3 |
| 2,872,715 | 2/1959 | Bean | 164/10 |
| 3,461,944 | 8/1969 | Kuebrich | 164/97 X |

FOREIGN PATENT DOCUMENTS

| | | | |
|---|---|---|---|
| 2655503 | 6/1978 | Fed. Rep. of Germany | 164/9 |

*Primary Examiner*—James L. Jones, Jr.
*Assistant Examiner*—Debra S. Meislin
*Attorney, Agent, or Firm*—Krass, Young & Schivley

[57] ABSTRACT

A rotary drill bit for drilling wells in earth formations is produced by a casting technique using a plastic foam, combustible casting form. The bit includes a tapered drill body having a plurality of passageways therein which form jets for introducing liquid between the earth and a plurality of selectively arranged, cutting members extending outwardly from the drill body. The combustible form is molded in a shape substantially identical to that of the drill body. The cutting members are mounted on the form in the selective arrangement thereof, and the assembly of the form and cutting members are then coated with a mold material to form a mold body. A cavity is created in the form for receiving a molding mandrel which defines the longitudinal passageway of the completed bit. Molding pins are introduced through the mold body into the mandrel to precisely hold the mandrel relative to the mold body. The cutting members are precisely held by the mold body after the form is removed by combustion. Molten steel is introduced into the mold cavity, between the mold body and the mandrel to form the drill body. The mold body and mandrel are then removed from the completed bit by chemical treatment. The cutting members include a cobalt and/or nickel binder and are coated with a special substance to form a barrier between the drill body and the cutting members thereby to prevent adverse chemical reaction between the molten steel and the cobalt and/or nickel of the cutting members.

18 Claims, 10 Drawing Figures

PROCESS FOR PRODUCING A ROTARY DRILLING BIT

TECHNICAL FIELD

The present invention generally relates to processes for casting metal parts having metal inserts therein. More particularly, the invention deals, in one sense, with a rotary drill bit for drilling wells in the earth, and in another sense deals with a method of producing a cast steel product having metal inserts formed therewithin which include a cobalt and/or nickel binder.

BACKGROUND ART

Rotary drill bits, such as that disclosed in U.S. Pat. No. 3,915,246, are being employed with increasing frequency for drilling oil wells, gas wells and the like. These drill bits represent a substantial improvement over previous bits of the three-cone type in which three rauls each having a plurality of cutting members were journalled for rotation at the tip of the drill bit. The improved bit construction disclosed in the patent mentioned above is provided with a specially configured drill body in which the cutting members, typically carbide, are stationarily mounted in a helical arrangement on the drill body. The drill body also includes a number of internal passageways which terminate in jet apertures adjacent the cutting members to introduce a jet of fluid into the cutting area thereby to improve cutting of earth formations.

The improved bit construction described above has heretofore been produced by machining a billet of metal into the desired drill body configuration; holes were then drilled into the surface of the drill body and the cutting members were inserted and secured within these holes. The fluid passageways within the drill body were also produced by machining techniques. The bit produced by this previous process was entirely satisfactory from a quality standpoint but was quite expensive due to the equipment and labor required to perform the machining operations. A less costly method of casting the bit has not been previously successful for several reasons. First, the cutting members, which comprise either carbide or high strength steel, typically include a certain quantity of cobalt and/or nickel which is used as a binder. It is well known that molten steel coming into contact with a metal product having a cobalt and/or nickel binder oxidizes the cobalt and/or nickel, particularly at the interface between cast steel and the metal product. This oxidation is due to molecular movement of the molten steel and/or cobalt and nickel at the interface and results in an oxidized layer of cobalt and/or nickel at such interface. The oxidized layer not only reduces the bond between the cast steel and the metal product, but also damages the metallurgical integrity of the metal product itself.

Another reason that the improved drill bit has not been previously produced by casting techniques is related to the need for carefully positioning the cutting members in a preselected pattern on the surface of the drill body. Known techniques for casting a material around a plurality of inserts do not allow precise positioning of the inserts relative to each other and in a preselected pattern.

According to one facet of the invention, a process for producing rotary drill bits is provided which involves inexpensive casting techniques. In accordance with another facet of the invention, however, a novel process is provided for casting high strength metal inserts, of the type including cobalt and/or nickel binders, within molten steel, which eliminates oxidation of the cobalt and/or nickel by the hot steel.

DISCLOSURE OF THE INVENTION

In one aspect of the invention, a process for producing a cast steel product having a high strength metal insert therein of the type including a cobalt and/or nickel binder includes the step of coating the surface of the insert with a layer of material to form a barrier which prevents migration of steel or cobalt molecules therethrough, thereby preventing oxidation of the cobalt and/or nickel by the hot steel. The coating preferably comprises tantalum nitrite, titanium nitride, or aluminum oxide.

In another aspect of the invention, a method of producing a rotary drill bit employs casting techniques using a foam plastic casting form. Metal inserts, which define high strength cutting members in the completed bit, are mounted on the form, and a mold material such as sand slurry is applied to the surface of the form and is cured to produce a ceramic mold body having portions of the inserts captively held therein. A molding mandrel is then inserted into a cavity in the form and is held in a precise, fixed position by molding pins which extend through the mold body into the mandrel. The molding assembly is then placed in an oven to vaporize the form by combustion. Molten steel is then introduced into the mold cavity defined between the mandrel and the mold body to cast the drill body around the inserts. The mold body and mandrel are finally separated from the completed drill bit using chemical techniques such as alkaline leaching.

BRIEF DESCRIPTION OF THE DRAWINGS

In the drawings, which form an integral part of the specification and are to be read in conjunction therewith, and in which like components are designated by identical reference numerals in the various views.

DETAILED DESCRIPTION OF THE INVENTION

Figure 1:
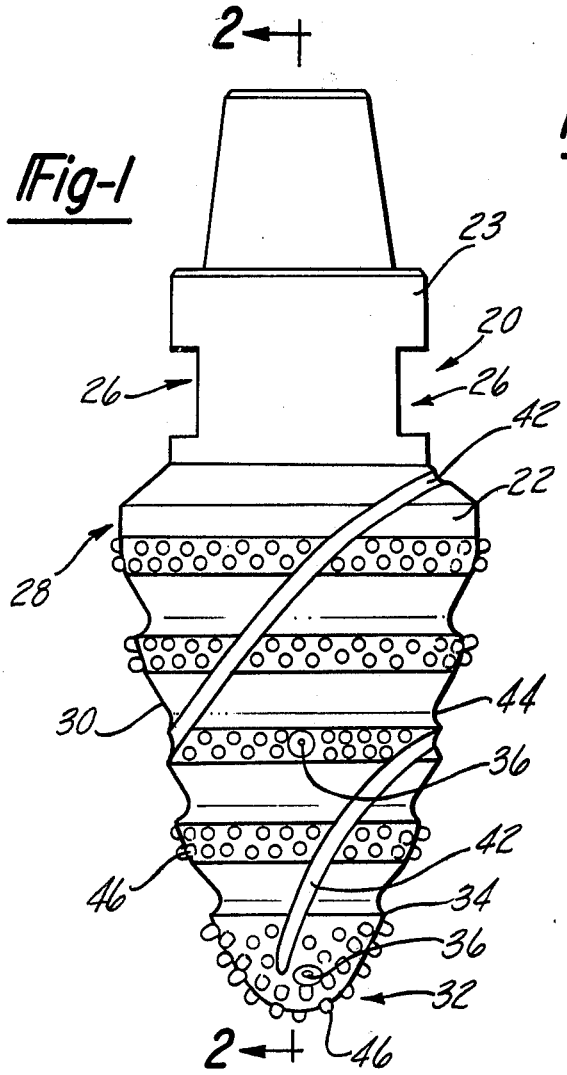
FIG. 1 is an elevational view of the rotary drill bit produced in accordance with the process of the present invention.
Figure 2:
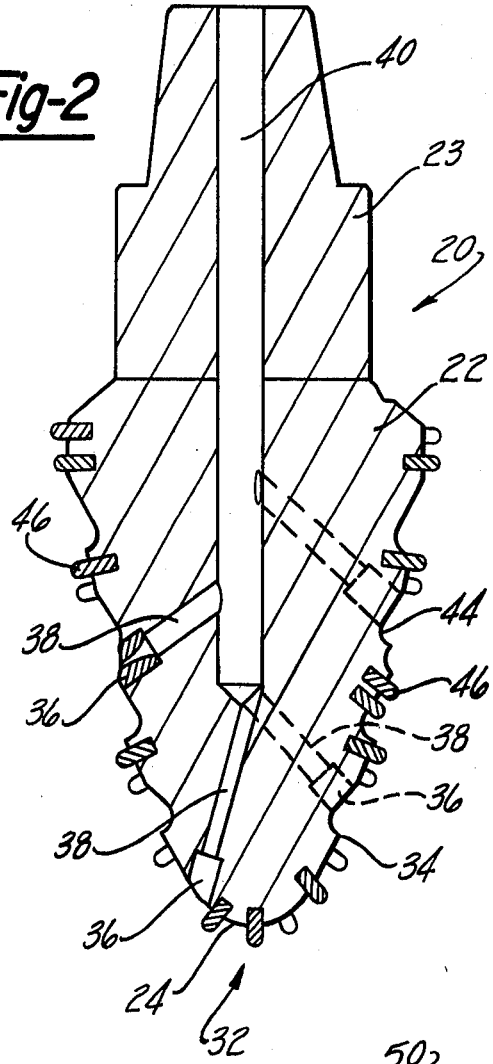
FIG. 2 is a cross sectional view taken along the line 2—2 of FIG. 1.
Figure 3:
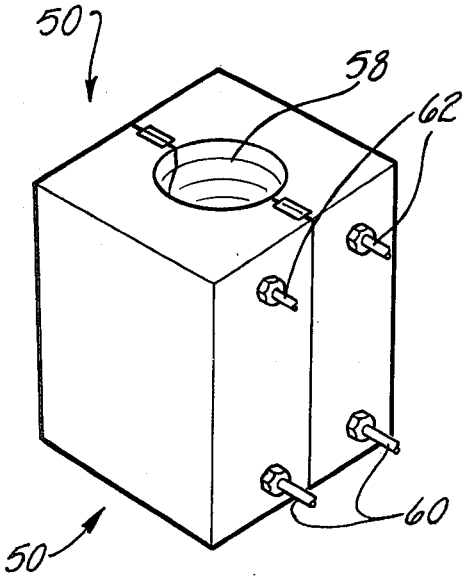
FIG. 3 is a perspective view of apparatus for molding the combustible pattern form used in the process to produce the bit shown in FIG. 1, the mold being shown in the closed, molding position.
Figure 4:
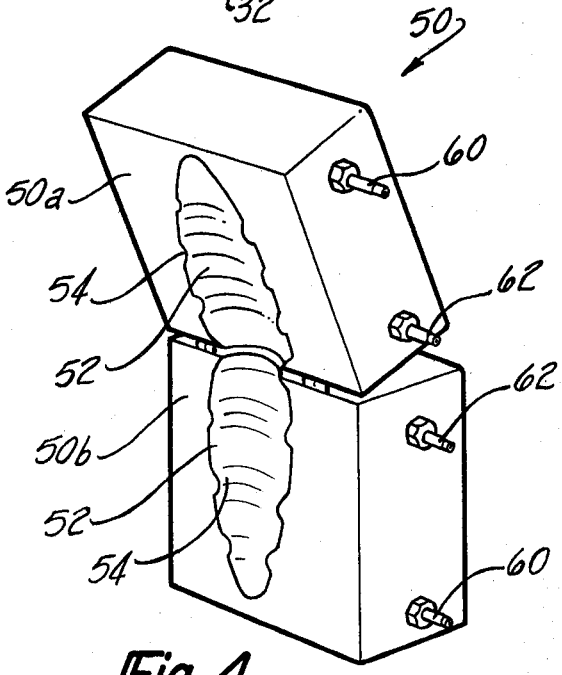
FIG. 4 is a view similar to FIG. 3 but showing the mold halves in an open position.

Referring first to FIGS. 1 and 2, the present invention is concerned, in one sense, with a process for producing a rotary drill bit generally indicated by the numeral 20. Drill bit 20 includes a body 22 having a threaded adapter collar 23 for connection to a conventional drill string (not shown). Typically, collar 23 will include a pair of breaker slots 26 on opposite sides thereof which are adapted to receive a tool therein employed to mount and dismount the collar 23 on the drill string. Body 22 includes three portions defined by an upper full gage stabilizer portion generally indicated at 28, an intermediate taper section 30 and a lower nose section 32.

The stabilizer portion 28 assures a full gage hole is produced while preventing hole deviation. The taper section 30 tapers downwardly from the stabilizer portion 28 in a generally linear manner to a reduced diameter indicated at 34. The taper section 30 permits the contact of the cutting edges of the bit with the formation to be drilled and allows positioning of fluid jet apertures 36 quite close to the formation to be drilled in order to maximize the hydraulic forces acting on the rock. Apertures 36, defined at the outer surface of the body 22, communicate with distribution passageways 38, which extend upwardly and inwardly to a central, longitudinally extending fluid delivery conduit 40.

The nose section 32 has a lower central portion 24 which may be pointed, rounded, elliptical or flat, but which is configured to permit the concentration of load on the centralized area of the bit.

The body 22 includes a plurality of longitudinally extending, helically shaped grooves 42 in the surface thereof which are spaced about the periphery of body 22. Grooves 42 are generally concave in cross section and provide a cutting flow from the bottom of the hole during drilling operations in order to expose new rock surfaces for the cutting edges of the bit. The grooves 42 are curved in the direction of bit rotation.

Body 22 further includes a plurality of circularly extending grooves 44 which traverse helical grooves 42 and are longitudinally spaced from each other. Grooves 44 are concave in cross section and function to provide stress relief openings in order to accommodate and encourage rock failure during drilling operations. Additionally, grooves 44 insure proper cleaning of the cutting edges of the bit from the rock being cut and eliminate compression thereby allowing the rock to move and fail in tension and shear, thus assisting in the cutting operations and removal of the rock upwardly through the helical grooves 42. The helical and transverse grooves 42 and 44, respectively, intersect to form a plurality of generally rectangular areas of various sizes over the entire body 22. A plurality of discrete cutting members 46 are disposed over the rectangular areas. Cutting members 46 are formed from high strength steel or carbide using powder-metallurgic techniques, and typically employ a powder-metal binder such as cobalt and/or nickel. Cutting members 46 are secured within the body 22 and extend outwardly from the surface of the body 22. Cutting members 46 may be of different sizes and differently spaced throughout the rectangular areas on body 22. At least certain of the cutting members 46 are of different lengths than the remainder thereof and form a helical pattern around the surface of the body 22; this arrangement assists the advance of the bit with a minimum of required thrust. The cutting members 46 disposed on the nose section 32 are preferably somewhat smaller in size than the cutting members 46 on the remainder of the body 22, and may be provided with different angles of inclination in order to cut at various radii during rotation of the bit.

The drill bit 20 may be utilized for conventional drilling at conventional speeds with ordinary pressures of drilling fluid being applied. Also, bit 20 may be employed for high pressure jet drilling wherein very high pressures, in a range of from 10,000 to 20,000 psi of drilling fluid pressure are provided.

Referring now to FIGS. 3–10, the bit 20 shown in FIGS. 1 and 2 may be produced using a process which forms one important aspect of the present invention. The process involves casting the drill body 22 using a mold defined by combustible form 48. The form 48 has an exterior surface substantially identical in dimension (with allowance for metal shrinkage) and configuration to that of the body 22, and is preferably produced by molding. In this connection, a mold assembly 50 may be provided which includes first and second mold halves 50A and 50B hingedly connected together and each provided with a mold cavity 52 which defines one half of the form 48. Cavities 52 include semi-circular, transversely extending ridges 54 for producing circularly extending grooves 56 in the form 48. Grooves 56 correspond to grooves 44 in drill body 22. In order to mold the form 48, the mold halves 50A and 50B are closed and a quantity of suitable foam is introduced into the mold assembly 50 through aperture 58. A number of plastic foams are suitable for use in molding the form 48. Preferably, such foams are of a styrene base and produce a very low ash content when vaporized during combustion. Such foam is introduced into the mold assembly 50 at room temperature and may have a density of approximately two to three pounds per cubic foot. The mold assembly 50 is heated by means of hot water, oil or the like via fluid inlets 60 and outlets 62 which recirculate heating fluid from a source thereof through internal passageways in the mold halves 50A and 50B. A mounting stud 64 is preferably inserted into the mold cavity, in alignment with the longitudinal axis of the form 48, so as to extend from the base of the form 48 and provide a means for mounting the molded form 48 for later machining operations.

Figure 5:
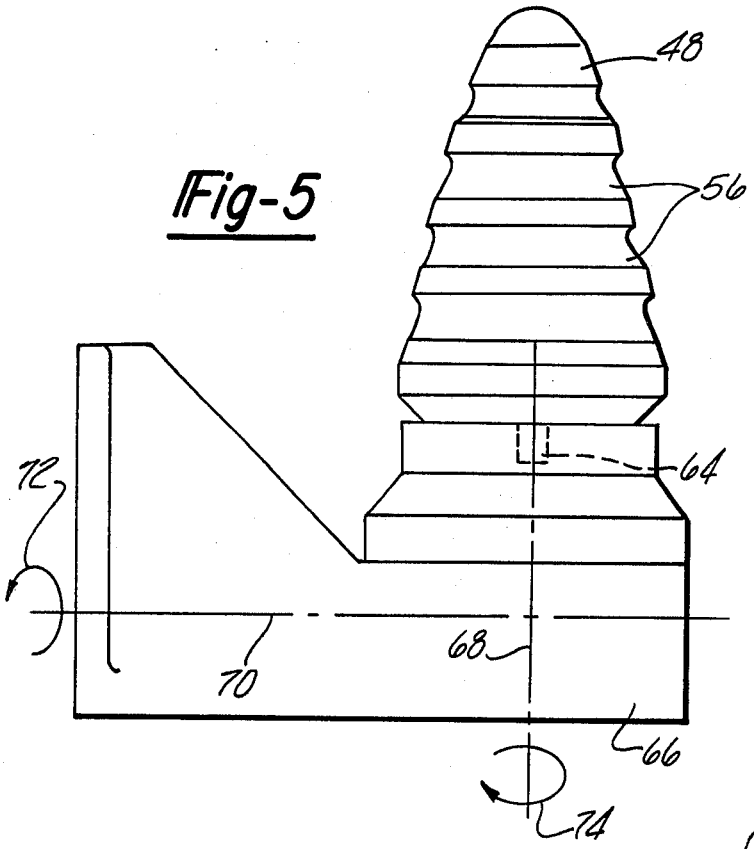
FIGS. 5–10 depict successive steps in the process for producing the bit shown in FIG. 1.
Figure 6:
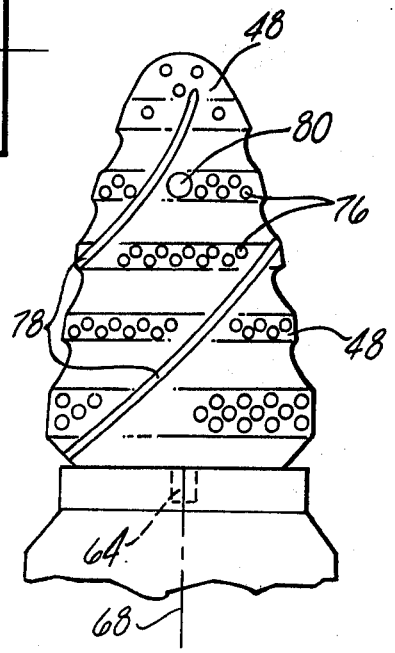
Figure 7:
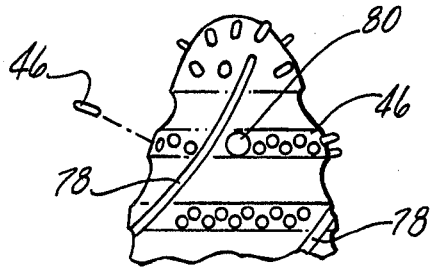

As shown in FIG. 5, after the form 48 is removed from the mold assembly 50, the surface thereof is essentially smooth except for the circumferential grooves 56. The partially completed form 48 is then mounted on a suitable fixture 66 by means of the mounting stud 64. Fixture 66 may be mounted in either of two positions on a suitable machining station for rotary motion about vertical and horizontal axes 68 and 70, respectively, in the direction of the arrows 72 and 74 as shown in FIG. 5. A series of apertures 76, helical grooves 78, and aligned bores 80 are then machined into the form 48. Grooves 78, as well as apertures 76 and bores 80, correspond precisely in dimension and location to grooves 42, cutting members 46 and apertures 36 associated with body 22.

At this point, the mounting stud 64 is removed, and the cutting members 46 are inserted into the apertures 76. However, before insertion, the cutting members 46 are coated with one or more layers of material which forms a barrier substantially preventing the migration of cobalt or steel alloy molecules therethrough. Tantalum nitrite has been found to be particularly effective, even when cast in molten steel having a temperature up to 3000° C. Titanium nitride is also an acceptable coating. Aluminum oxide, although less preferred than the compounds mentioned above, can also be employed as the coating. In any event, these compounds form a chemical bond with the cutting members 46. Other materials forming a mechanical bond might also be employed, but with substantially less effectiveness. The coating applied to the cutting members 46 should be at least 0.002 inch thick but is preferably in the range of 0.004 -0.005 inch thick. Coatings in the preferred range mentioned above may comprise two layers of the coating compound if necessary. In the case where the cutting members 46 are comprised of high strength steel, the coating may comprise a first layer of titanium carbide covered by a second layer of titanium nitride.

The coatings may be applied to the cutting members 46 using chemical vapor deposition processes carried out at temperatures between 1750° F. (954° C.) to 1930° F. (1054° C.). As previously mentioned, a chemical bond is created between the coating and cutting members 46 which act as a substrate, however, it can be appreciated that a metallurgical bond therebetween is also produced.

Having installed the coated cutting members 46, a plurality of ceramic rods 82 are inserted into the bores 80 and extend into a longitudinally extending cavity 84 within the form 48. Cavity 84 may be produced by machining the molded form 48, or alternatively, may be produced by inserting a mandrel (not shown) into the mold assembly 50 during molding of the form 48.

Figure 8:
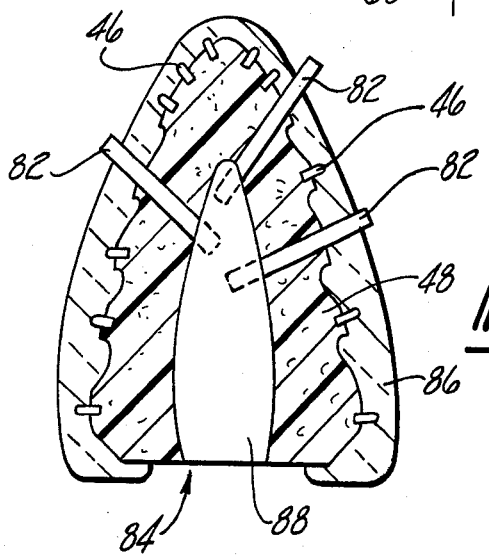

As shown in FIG. 8, the next step of the process of the present invention consists of applying a number of layers of molding material over the surface of the form 48 to form a coating 86 which surrounds the outer portions of the cutting members 46 and conforms with the various grooves in the surface of form 48. The coating 86 may comprise sand held together with a suitable binder so as to form a sand slurry; the slurry may be sprayed, dipped or applied in any other suitable manner in successive layers until the desired strength and thickness have been achieved. Other types of materials may be employed as the coating 86 if desired. In any event, it is important that the coating securely hold the outer portions of the cutting members 46 which extend outwardly beyond the surface of form 48.

Either before, during or after the coating 86 has been applied to the form 48, a mold mandrel 88, shown in FIG. 8, is inserted within the cavity 84. Mandrel 88 may also consist of a suitable molding material, such as a sand slurry, which is introduced into the cavity 84 and surrounds innermost portions of the rods 82. Alternatively, however, mandrel 88 may comprise a rigid, preformed slug of ceramic or other material which is inserted into the cavity 84 before the form 48 is removed, as will be discussed later. In the event that a preformed slug is employed as the mandrel 88, a series of apertures will be provided in such slug in carefully prepositioned locations so as to receive the inner ends of rods 82.

After the coating 86 has been applied, the coating form 48 is allowed to cure at room temperature. This curing period is particularly important where the coating 86 may contain alcohol or other combustible substances since the next processing step involves subjecting the form 48 to elevated temperatures, thus presenting an explosive hazard if combustible vapors are given off by the coating 86.

Figure 9:
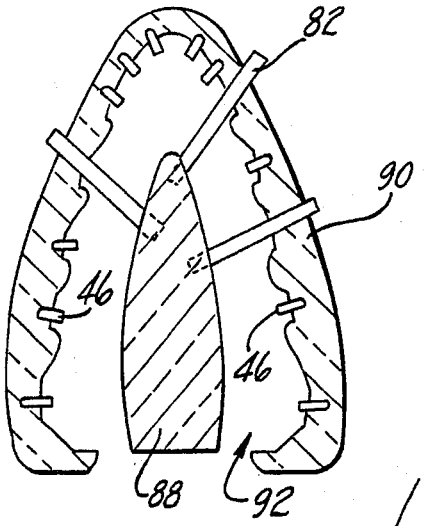

The completed ceramic mold comprising mold body 90, mandrel 88 and rods 82, having the form 48 trapped therewithin, as shown in FIG. 9, is then placed in an oven at a temperature sufficient to result in the substantially complete combustion of the form 48, typically 1900° F. Care must be taken, however to not leave the mold in the oven for an extended period of time sufficient to adversely affect the coatings previously applied to the cutting members 46.

The ceramic mold is then removed from the oven and allowed to cool to room temperature. It should be noted here that, although it has been previously indicated that the mandrel 88 is inserted into the cavity 84 prior to combusting the form 48, such mandrel may be installed within the mold body defined by coating 86 and interconnected with the rods 82 after the form 48 has been vaporized.

Before further processing, it may be desirable in some cases to apply one or more additional layers of molding material to the exterior surface of coating 86 in order to strengthen the mold body 90. It may be appreciated, as shown in FIG. 9, that after the form 48 has been vaporized, and the mandrel 88 has been installed, a mold assembly is provided comprising mold body 90 and mandrel 88 between which there is defined a mold cavity 92 which precisely corresponds in volume and geometry to drill body 22. Moreover, mold body 90 has the outer portions of cutting members 46 embedded therein, and therefore precisely maintains the attitude and location of the cutting members in the position in which they were initially installed in the form 48.

Figure 10:
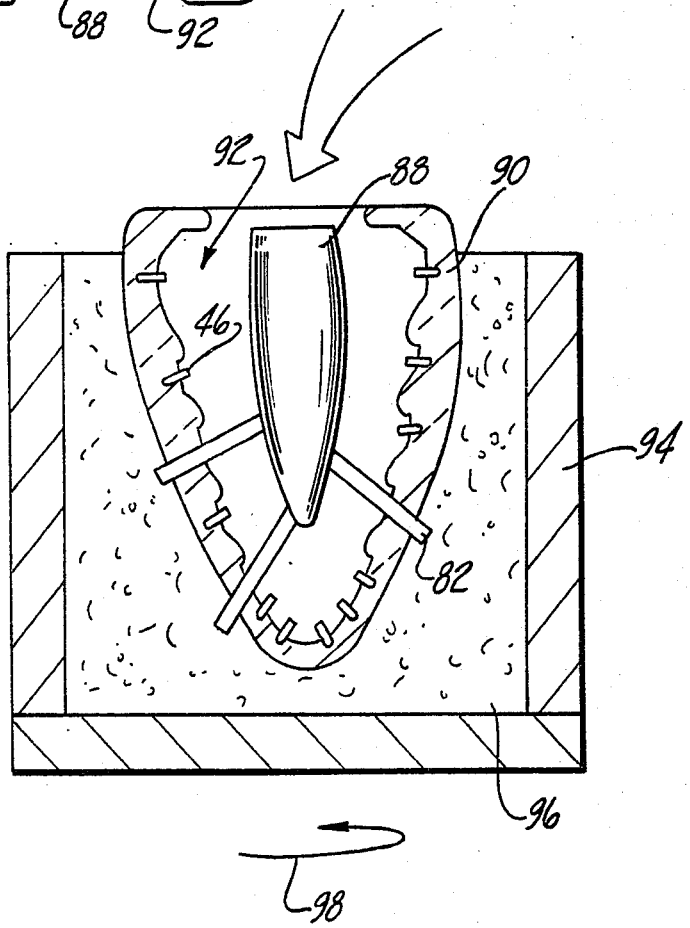

The next step in the process involves casting the drill body using the assembled ceramic mold. This casting step may be carried out using centrifugal casting techniques as shown in FIG. 10. The assembled mold is inserted in a casting bucket 94 which includes a quantity of liner material 96, such as sand, which conformingly engages, and therefore laterally supports, the exterior surfaces of mold body 90. Casting bucket 94 is adapted to rotate about the longitudinal axis of the mold assembly, in the direction of arrow 98. The bucket 94 having the mold installed therein is then preferably preheated, following which molten steel is poured into mold cavity 92 and bucket 94 is revolved. Typically, the molten steel may comprise type 4340 well known in the art at approximately 3000° F. As the molten steel contacts the exposed portions of cutting members 46, the previously mentioned coating on such cutting members prevents molecular movement of the molten steel and/or cobalt and/or nickel at the interface of the cutting members and molten steel, thereby preventing oxidation of the cobalt at such interface. As a result, an extremely good bond is achieved between the drill body 22 and the cutting members 46.

After the molten steel has cooled, the ceramic mold assembly is removed from the bucket 94 and the mold components comprising rods 82, mandrel 88 and mold body 90 are removed. Removal of the mold components is preferably performed by nonvibratory techniques involving chemical treatment. Such chemical treatment may consist of chemically leaching the ceramic material which comprises the mold components, using any suitable solution having a high alkaline content. Acidic solutions should be avoided for this purpose because of their reaction with the drill body 22. As noted earlier, vibratory processes for removing the mold components should be avoided because of risk of damage to the cutting members 46, which are relatively brittle. After the molding components are removed, the bit 20 may be cleaned, as by sand blasting the surface thereof, and the adapter collar 23 is then mounted on the drill body 22 as by welding.

From the foregoing, it can be appreciated that the novel processes described above not only provide for the reliable accomplishment of the objects of the invention but do so in a particularly effective and reliable manner. It is recognized, of course, that those skilled in the art may make various modifications or additions to the preferred embodiment chosen to illustrate the invention without departing from the scope and spirit of the present contribution to the art. Accordingly, it is to be understood that the protection sought and to be afforded hereby should be deemed to extend to the subject matter claimed and all equivalents thereof fairly within the scope of the invention.

What is claimed is:

1. A method of producing a rotary drill bit having a steel drill body and a plurality of carbide cutting members stationarily secured within said body and extending outwardly from the surface of said body, comprising the steps of:

(A) providing a combustible form having an exterior shape substantially identical to said drill body;

(B) mounting first portions of said cutting members in said form extending outwardly from the surface of said form and in respective positions substantially identical to the positions of said members with respect to said drill body;

(C) then, applying a molding material to the surface of said form and around second portions of said members;

(D) curing said molding material to produce a mold body conforming to the surface of said form and holding said second portions of said members;

(E) combusting said form to produce a mold cavity defined by said mold body;

(F) introducing molten steel into said cavity and around said first portions of said members whereby to cast said drill body around said members;

(G) cooling said cast drill body having said members therein; and (H) removing said mold body from said drill body.

2. The method of claim 1, wherein step (A) is performed by molding a quantity of plastic material and step (B) includes the substeps of producing a plurality of bores in said form and inserting said cutting members into said bores.

3. The method of claim 2, wherein step (A) includes the substep of machining at least one helically shaped groove in the exterior surface of said form.

4. The method of claim 1, including the step (I) of coating at least said first portions of said members with a layer of material which substantially prevents migration of steel, cobalt and/or nickel molecules therethrough, and wherein said members include a cobalt and/or nickel binder therein.

5. The method of claim 4, wherein step (I) is performed at a temperature of between 1750° F. and 1930° F.

6. The method of claim 4, wherein said material is a compound selected from the group consisting of:

(a) tantalum nitrite (b) titanium nitride, and (c) aluminum oxide.

7. The method of claim 1, including the steps of:

(J) forming a cavity in the interior of said form;

(K) inserting a removable mandrel in said form cavity;

(L) removing said mandrel after completing step (G) to provide a cavity within said drill body.

8. The method of claim 7, wherein step (A) is performed by molding a quantity of plastic material in a form mold and step (K) is performed by inserting the mandrel into said form mold.

9. The method of claim 7, including the steps of:

(M) forming aligned passageways in said mold body and said mandrel; and (N) inserting pins through said passageways and between said mandrel and said mold body to locate said mandrel at a selected position within said mold body and to form passageways in said drill body upon completion of steps (F) and (G).

10. The method of claim 9, wherein step (N) is performed after completing steps (J), (K) and (M).

11. The method of claim 1, wherein step (E) is performed by heating said form in an oven after performing steps (A), (B) and (C).

12. The method of claim 1, wherein step (H) is performed by the application of an alkaline solution to said mold body.

13. A method of producing a rotary drill bit having a steel drill body and a plurality of rigid cutting members secured in a preselected pattern on said drill body and extending outwardly from the surface of said body, comprising the steps of:

(A) producing a form having an exterior shape substantially identical to the exterior shape of said drill body;

(B) holding said cutting members in said preselected pattern using said form;

(C) covering said cutting members and said form with a molding material to create a mold body conforming to said exterior shape of said form;

(D) holding said cutting members in said preselected pattern using said mold body;

(E) removing said form from said mold body and said cutting members;

(F) introducing molten steel into said mold body and around said cutting members;

(G) cooling said molten steel to form said drill body having said cutting members held therein; and (H) removing said mold body from said drill body.

14. The method of claim 13, wherein step (C) is performed by applying successive layers of a sand slurry to said cutting members and said form.

15. The method of claim 13, including the step (I) of coating said cutting members with a material which substantially prevents the migration of molecules between said cutting members and said drill body.

16. The method of claim 15, wherein said material is a compound selected from the group consisting of:

(a) tantalum nitrite (b) titanium nitride, and (c) aluminum oxide.

17. The method of claim 13, wherein step (A) is performed by molding a quantity of plastic material into the general surface contour of said drill body and machining the surface of said molded plastic to obtain said exterior shape.

18. The method of claim 13, including the steps of:

(J) creating a cavity in said form;

(K) introducing a mandrel into said cavity in said form; and (L) holding said mandrel in a preselected position within said cavity using pins extending through said mold body and into said mandrel, said mandrel defining a cavity in said drill body after steps (F), (G) and (H) are completed.

* * * * *